US012753982B2

(12) United States Patent
Tasyagan

(10) Patent No.: US 12,753,982 B2
(45) Date of Patent: Oct. 6, 2026

(54) PLASTIC RECEIVER STRUCTURE ON PCP GUNS

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 0 days.

(21) Appl. No.: 18/851,633

(22) PCT Filed: Mar. 30, 2022

(86) PCT No.: PCT/TR2022/050279
§ 371 (c)(1),
(2) Date: Sep. 26, 2024

(87) PCT Pub. No.: WO2023/191732
PCT Pub. Date: Oct. 5, 2023

(65) Prior Publication Data
US 2025/0207875 A1 Jun. 26, 2025

(51) Int. Cl.
*F41B 11/60* (2013.01)
*F41A 3/66* (2006.01)

(52) U.S. Cl.
CPC ..... *F41A 3/66* (2013.01); *F41B 11/60* (2013.01)

(58) Field of Classification Search
CPC ..... F41B 11/62; F41B 11/60
See application file for complete search history.

(56) References Cited

U.S. PATENT DOCUMENTS 10,488,149 B2 * 11/2019 Tasyagan ..... F41B 11/62

FOREIGN PATENT DOCUMENTS

| | | | |
|---|---|---|---|
| WO | 2008147491 | A2 | 12/2008 |
| WO | 2011103977 | A1 | 9/2011 |
| WO | 2020232481 | A1 | 11/2020 |

OTHER PUBLICATIONS

International Search Report in International Application No. PCT /TR2022/050279 mailed on Jan. 18, 2023.
Written Opinion of the International Searching Authority in International Application No. PCT /TR2022/050279 mailed on Jan. 18, 2023.

* cited by examiner

*Primary Examiner* — Reginald S Tillman, Jr.
(74) *Attorney, Agent, or Firm* — Phil IP Law Inc.; Narek Zohrabyan; Karen 'Kirk' Galoyan

(57) ABSTRACT

The subject of the present invention relates to a plastic receiver formed from plastic and plastic type materials by plastic injection or 3D printer method, which enables the preloaded pneumatic gun elements to be connected thereon.

7 Claims, 2 Drawing Sheets

PLASTIC RECEIVER STRUCTURE ON PCP GUNS

TECHNICAL FIELD

The subject of the present invention relates to a plastic receiver formed from plastic and plastic type materials by plastic injection or 3D printer method, which enables the preloaded pneumatic gun elements to be connected thereon.

PRIOR ART

In the state of the art, in existing pre-charged pneumatic guns, the receiver is produced by processing metal materials (Iron, Aluminum, etc.). While creating the receiver, contact points are created on which the gun elements will be attached. These processes are very difficult and costly depending on the type of material. During production, more than one machine and manpower are required. In addition thereto, the receiver made of metal and derivative materials significantly increases the weight of the gun.

In the state of the art, it is known that there are receivers made of plastic and derivative materials in rifles. However, pistols are firearms with smaller volumes than rifles. Accordingly, the receivers in pistols are also smaller in volume than the receivers in rifles. This necessitates forming the points where the gun elements will be connected more precisely on the receiver. Working on small-scale parts is more laborious in terms of production, and different processes are applied in production than large-scale parts. Gun receivers made of plastic and derivative materials that require delicate labor cannot take their place in the market due to production difficulties.

Consequently, existence of the aforementioned problems in and the inefficacy of the available solutions necessitated making an improvement in the art.

OBJECTS OF THE INVENTION

The object of the present invention is to obtain a pre-charged pneumatic gun receiver made of plastic and the derivatives thereof, which will eliminate all the above-mentioned disadvantages. In addition to being easy and light to manufacture, the subject of the invention is the plastic receiver, and the points where the gun elements are connected are readily formed. The receiver has contact points without the need for any drilling during the production. Holes, slots and/or cavities forming the contact points on the receiver of the present invention can be produced in a solid manner by plastic injection or 3D printer method. All holes, slots and/or cavities on the receiver have been created according to the shape of the element to which it will be connected, and each has different forms.

DETAILED DESCRIPTION OF THE INVENTION

The pre-charged pneumatic gun receiver realized to achieve the object of the present invention is illustrated by the attached figures.

Figure 1:
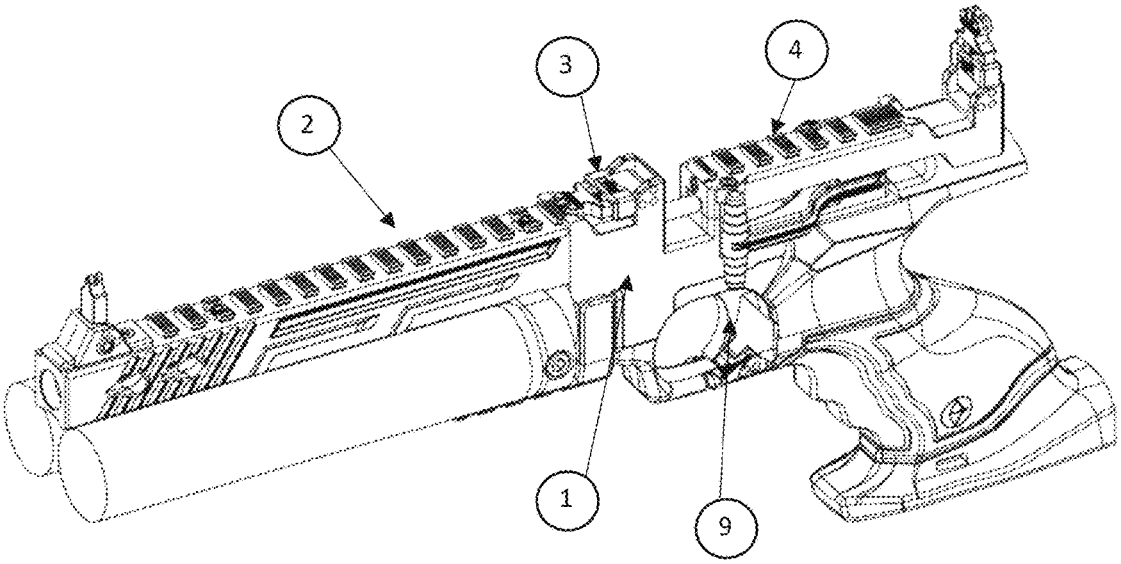
FIG. 1 illustrates the general view of the pre-charged pneumatic gun.

Parts of the inventive pre-charged pneumatic gun receiver are enumerated in figures in order to ensure a better understanding. Wherein;

1. Receiver
2. Barrel Liner
3. Backsight Body
4. Receiver Upper Cover
5. Arm
6. Pin Retainer
7. Receiver Side Cover
8. Picatinny Rail
9. Trigger
10. Barrel Hole
11. Air Tube Hole
12. Retaining Pin Hole
13. Backsight Housing
14. Backsight Pin Hole
15. Cover Hole
16. Upper Housing
17. Rail Rib
18. Valve Seat
19. Hammer Spring Seat
20. Spring Pin Hole
21. Side Cover Hole FIG. 1 illustrates the general view of the pre-charged pneumatic gun. The receiver (1) of the pre-charged pneumatic gun is made of plastic and a derivative material. The receiver (1) has a solid structure created by plastic injection or 3D printing method. The points where the other elements of the pre-charged pneumatic gun (slot, hole and/or cavity) are connected on the receiver (1) were created during the manufacturing method of said receiver (1), and no drilling and/or carving operations took place after the receiver (1) was obtained.

Figure 2:
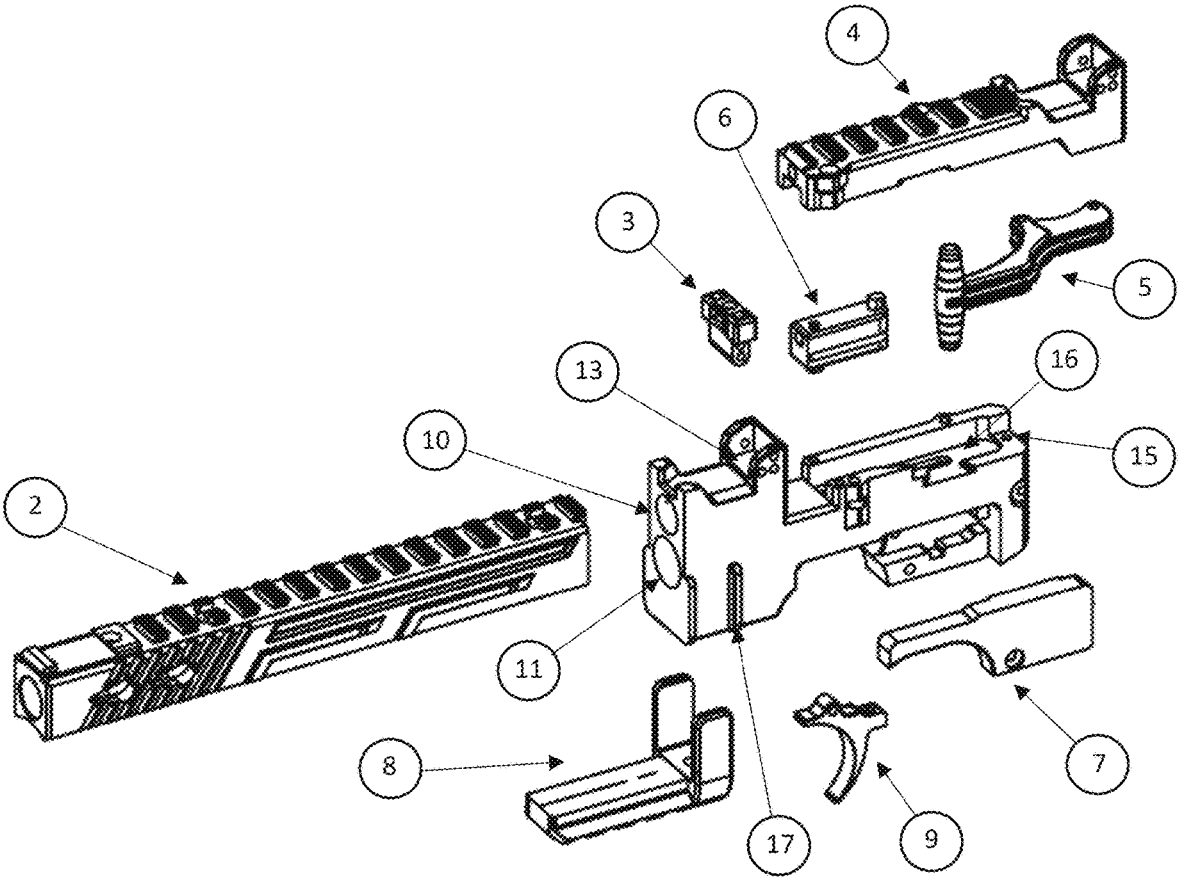
FIG. 2 illustrates the exploded view of the receiver and its elements connected to the receiver.
Figure 3:
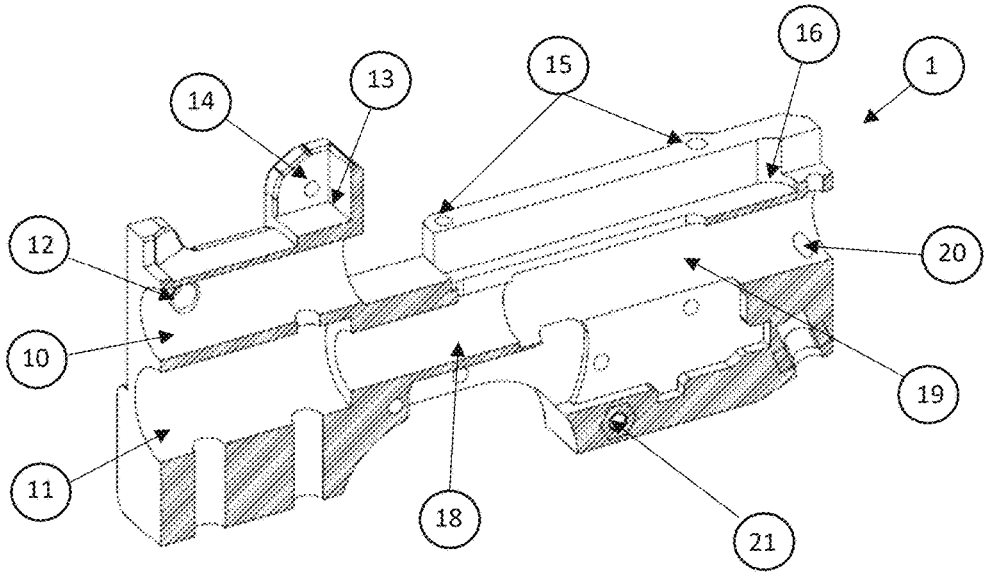
FIG. 3 illustrates the sectional view of the receiver.
Figure 4:
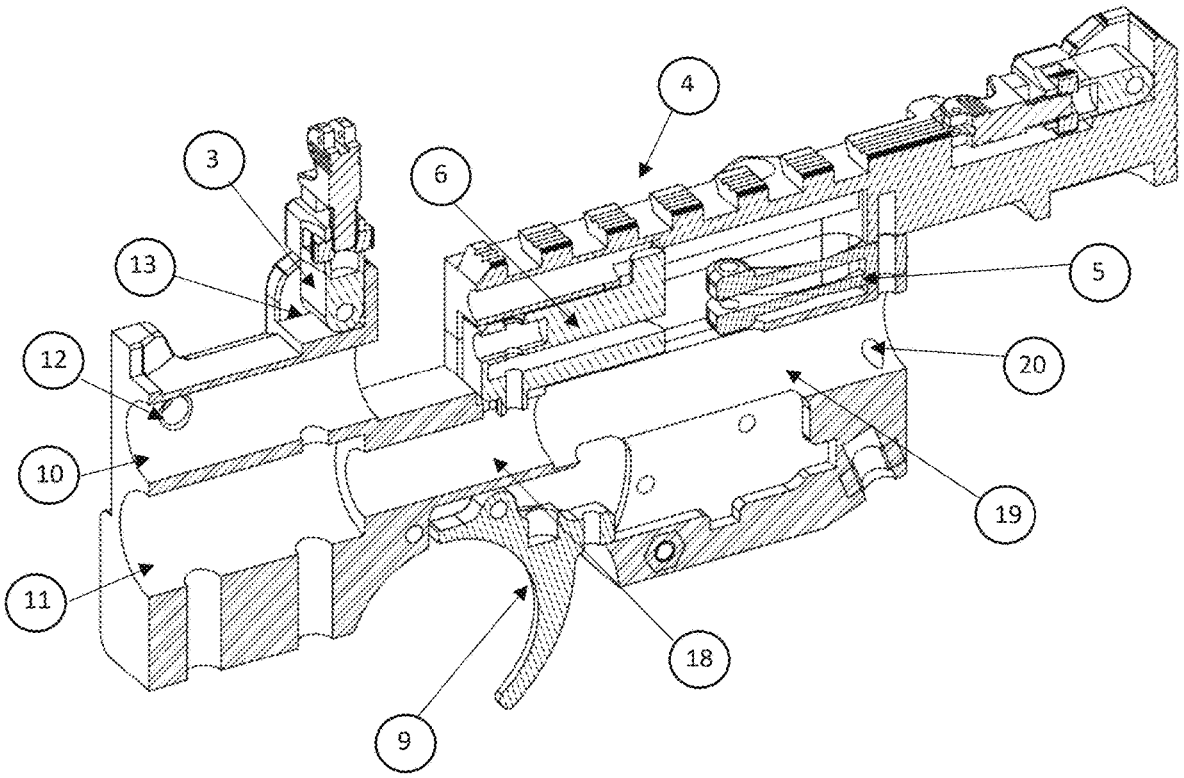
FIG. 4 illustrates the sectional view where the elements are connected on the receiver.

The barrel liner (2) seen in FIG. 2 is connected to the upper part of the front part of the receiver (1). There is a barrel hole (10) on said receiver (1) in order to connect the barrel liner (2) to the receiver (1). The diameters of the barrel hole (10) on the receiver (1) and the barrel liner (2) are equal to each other, and the barrel is passed through them. There is a retaining pin hole (12) formed on the receiver (1) in order to keep the barrel fixed through the barrel hole (10). The barrel inside the barrel hole (10) is attached to the receiver (1) with the pin passed through the retaining pin hole (12).

There is an air tube hole (11) under the barrel hole (10) located on the upper part of the front part of the receiver (1). The air tube hole (11) is the place where the air tube in pre-charged pneumatic guns is connected. The air tube and the air tube hole (11) are of equal diameter to each other. Another element involved in connecting the air tube in the pre-charged pneumatic gun to the receiver (1) is the picatinny rail (8). In order for the arms extending from both sides of the picatinny rail (8) to fit on the receiver (1), there are rail ribs (17) on both sides of said receiver (1). Rail ribs (17) are located on both sides of the receiver (1) and are hollows in the form of rods.

There is a backsight housing (13) on the upper surface of the receiver (1), where the backsight body (3) is positioned. In order for the backsight body (3) to be connected to the receiver (1), backsight pin holes (14) are formed on the backsight housing (13). The pins passed through the backsight pin holes (14) are connected to the backsight body (3).

The receiver upper cover (4) of the receiver is seated on the upper surface of the receiver (1), behind the backsight body (3). There are cover holes (15) on said receiver (1) for the receiver upper cover (4) to sit on the receiver (1). The tabs on the lower surface of the upper cover (4) of the receiver are engaged to the cover holes (15). In this way, the receiver upper cover (4) of the receiver is fixed on the receiver (1). There is an upper housing (16) extending along said receiver upper cover (4) and in the area above the receiver (1) where the receiver upper cover (4) is fixed. The upper housing (16) is located just under the receiver upper cover (4), and it has a hollow form forming a complete structure with the hollow form in the inner structure of said receiver upper cover (4). The pin retainer (6) is positioned in the front part in the upper housing (16), and the arm (5) is positioned in the rear part. The head part of the arm (5), which is positioned in the upper housing (16), is contacted with the pin retainer (6).

The receiver upper cover (4), which is connected on the receiver (1), and the backsight body (3) do not come into contact with each other. There is a gap between the receiver upper cover (4) and the backsight body (3) where the pin, which is involved in the exit of the bullet from the barrel, is passed through.

Under the upper housing (16), there is a hammer spring seat (19) formed inside the receiver (1). The hammer spring seat (19) has a cylindrical form and the hammer and hammer spring are passed inside said hammer spring seat (19). There is a spring pin hole (20), which is a hole formed at the end of the hammer spring seat (19) on the receiver (1). The pin passed through the spring pin hole (20) holds the hammer spring in the hammer spring seat (19).

There is a valve seat (18) formed inside the receiver (1) located between the air tube hole (11) and the hammer spring seat (19). Inside the valve seat (18), there is an air outlet valve, one end of which is connected to the hammer.

Under the hammer spring seat (19), there is a receiver side cover (7), which is connected to the receiver (1). There is a side cover hole (21) formed in the lower part of said receiver (1) such that the receiver side cover (7) can be connected to the receiver (1). In addition, the inner surface of said receiver (1) has a stepped structure such that the side cover (7) of the receiver can be connected to the receiver (1). The trigger (9) is connected to the side cover (7) of the receiver which is fixed on the receiver (1). Also, the circular form of the trigger (9) in the holding part provides a crescent appearance by visually integrating with the part of the receiver (1) facing said trigger (9).

The invention claimed is:

1. A pre-charged pneumatic gun receiver, comprising:

a barrel hole connected to a barrel liner with matching diameters;

an air tube hole, located under the barrel hole, that is connected to an air tube;

a backsight housing located on an upper surface of a receiver where a backsight body is positioned;

an upper housing, encapsulated in between an upper area of the receiver and a receiver upper cover, wherein the upper housing holds a pin retainer and an arm;

a hammer spring seat with a cylindrical form located within the receiver under the upper housing, wherein the hammer spring seat holds a hammer and a hammer spring;

a valve seat, locate between the air tube hole and the hammer spring seat and through which the air outlet valve is positioned; and wherein the receiver is made of a plastic material.

2. The pre-charged pneumatic gun receiver of claim 1, further comprising a retaining pin hole, located on the receiver, whereby a pin inserted through the retaining pin hole affixes a barrel that is inserted through the barrel liner and the barrel hole.

3. The pre-charged pneumatic gun receiver of claim 1, further comprising:

at least one rail rib, which has a hollow form in the form of a bar, located on both sides of the receiver; and a picatinny rail with arms extending from both sides of the picatinny rail that connect an air tube to the receiver.

4. The pre-charged pneumatic gun receiver of claim 1, further comprising a backsight pin hole, wherein a pin is inserted through and into the backsight body to secure it unto the receiver.

5. The pre-charged pneumatic gun receiver of claim 1, further comprising at least one cover hole, located at an upper surface of the receiver, wherein matching tabs extending from a lower surface of the receiver upper cover are aligned with the at least one cover hole, thereby connecting the receiver upper cover to the receiver.

6. The pre-charged pneumatic gun receiver of claim 1, further comprising a spring pin hole, formed within an end section of the hammer spring seat, through which a pin is inserted which retains the hammer spring inside the hammer spring seat.

7. The pre-charged pneumatic gun receiver of claim 1, further comprising a side cover hole, formed in a lower region of the receiver, through which a pin is inserted into as to connect a receiver side cover to the receiver.

* * * * *